US006341397B1

(12) United States Patent
Kliegl et al.

(10) Patent No.: US 6,341,397 B1
(45) Date of Patent: Jan. 29, 2002

(54) BABY WRAPPING BLANKET

(76) Inventors: Deborah D. Kliegl; Thomas L. Kliegl, both of 5814 Burr Oak Ave., Berkeley, IL (US) 60163

( * ) Notice: Subject to any disclaimer, the term of this patent is extended or adjusted under 35 U.S.C. 154(b) by 0 days.

(21) Appl. No.: 09/663,531

(22) Filed: Sep. 15, 2000

(51) Int. Cl.[7] ..... A47G 9/02; A41B 13/06
(52) U.S. Cl. ..... 5/482; 2/69.5
(58) Field of Search ..... 5/482, 485, 655, 5/494; 2/69, 69.5; 128/872, 869

(56) References Cited

U.S. PATENT DOCUMENTS

| | | | | |
|---|---|---|---|---|
| 2,989,753 A | | 6/1961 | Burner | 2/69.5 |
| 3,034,132 A | | 5/1962 | Landsberger et al. | |
| 4,125,903 A | * | 11/1978 | Farrell | 5/485 |
| 4,897,885 A | | 2/1990 | Lunt | 2/69.5 |
| 5,058,226 A | * | 10/1991 | Cresby | 5/494 |
| 5,243,724 A | | 9/1993 | Barnes | 5/482 |
| 5,852,827 A | | 12/1998 | Lear | 5/482 |
| D407,258 S | | 3/1999 | Swink | D6/603 |
| 6,145,932 A | * | 11/2000 | Hamel-Nyhus et al. | 5/494 |

* cited by examiner

*Primary Examiner*—Alexander Grosz

(57) ABSTRACT

A baby wrapping blanket for providing warmth and comfort to an infant. The baby wrapping blanket includes a panel. The panel has a top surface, a bottom surface, a bottom edge, two lower side edges extend away and taper outwardly from the bottom edge and two upper side edges each extend away and taper inwardly from one of the lower side edges such that the panel generally has a pentagonal shape. The panel comprises a cloth material. A flap portion has a bottom edge, a top edge, a first side edge and a second side edge. The bottom edge of the flap portion is integrally coupled to the bottom edge of the panel. The flap portion is abutted against the front surface of the panel to define a pocket. The legs of the baby are placed in the pocket and the panel wrapped about the baby.

9 Claims, 2 Drawing Sheets

FIG.3
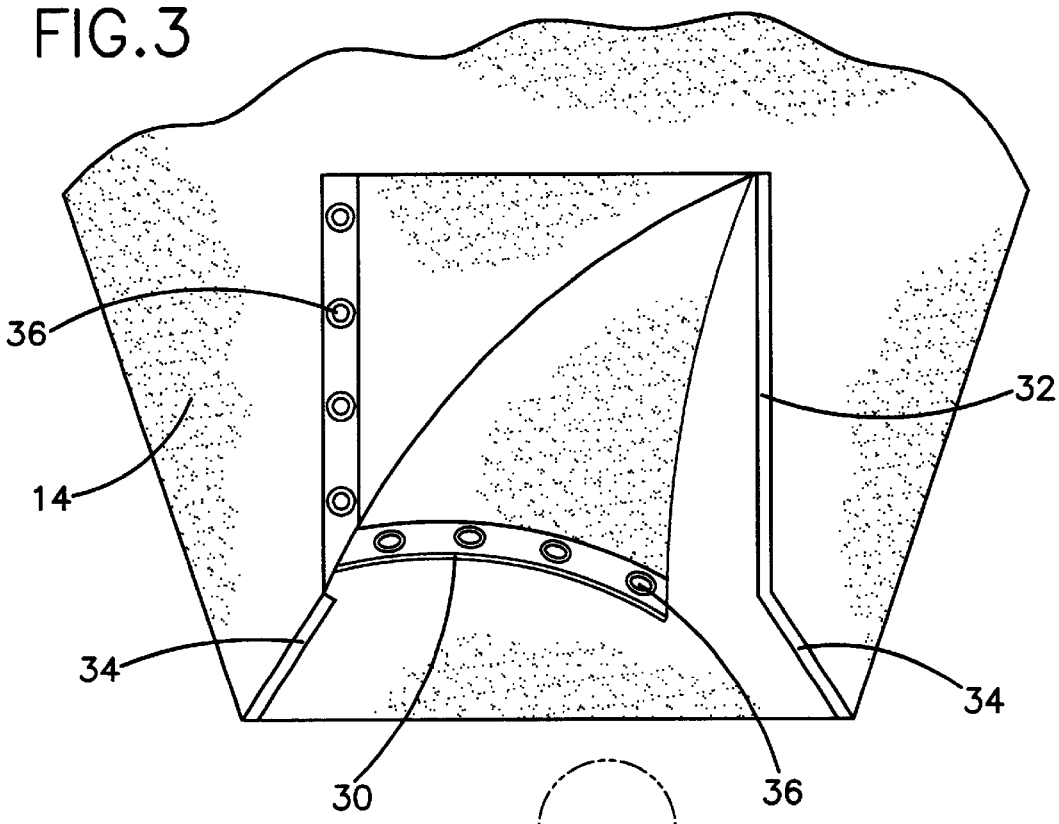
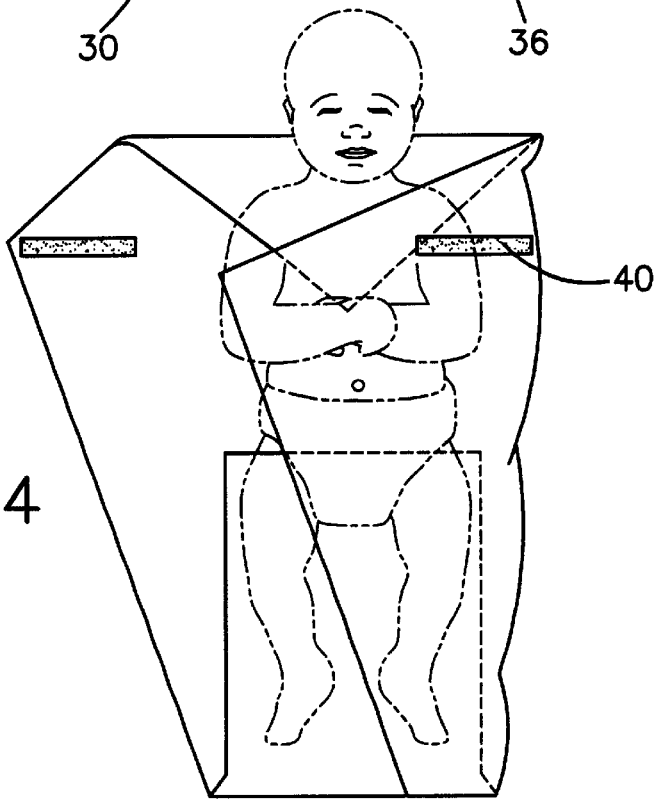
FIG.4

BABY WRAPPING BLANKET

BACKGROUND OF THE INVENTION

1. Field of the Invention

The present invention relates to baby blankets and more particularly pertains to a new baby wrapping blanket for providing warmth and comfort to an infant.

2. Description of the Prior Art

The use of baby blankets is known in the prior art. More specifically, baby blankets heretofore devised and utilized are known to consist basically of familiar, expected and obvious structural configurations, not withstanding the myriad of designs encompassed by the crowded prior art which have been developed for the fulfillment of countless objectives and requirements.

Known prior art includes U.S. Pat. No. 3,034,132; U.S. Pat. No. 5,852,827; U.S. Pat. No. 2,989,753; U.S. Pat. No. 4,897,885; U.S. Pat. No. 5,243,724; and U.S. Des. Pat. No. 407,258.

While these devices fulfill their respective, particular objectives and requirements, the aforementioned patents do not disclose a new baby wrapping blanket. The inventive device includes a panel. The panel has a top surface, a bottom surface, a bottom edge, two lower side edges extend away and taper outwardly from the bottom edge and two upper side edges each extend away and taper inwardly from one of the lower side edges such that the panel generally has a pentagonal shape. The panel comprises a cloth material. A flap portion has a bottom edge, a top edge, a first side edge and a second side edge. The bottom edge of the flap portion is integrally coupled to the bottom edge of the panel. The flap portion is abutted against the front surface of the panel to define a pocket. The legs of the baby are placed in the pocket and the panel wrapped about the baby.

In these respects, the baby wrapping blanket according to the present invention substantially departs from the conventional concepts and designs of the prior art, and in so doing provides an apparatus primarily developed for the purpose of providing warmth and comfort to an infant.

SUMMARY OF THE INVENTION

In view of the foregoing disadvantages inherent in the known types of baby blankets now present in the prior art, the present invention provides a new baby wrapping blanket construction wherein the same can be utilized for providing warmth and comfort to an infant.

The general purpose of the present invention, which will be described subsequently in greater detail, is to provide a new baby wrapping blanket apparatus and method which has many of the advantages of the baby blankets mentioned heretofore and many novel features that result in a new baby wrapping blanket which is not anticipated, rendered obvious, suggested, or even implied by any of the prior art baby blankets, either alone or in any combination thereof.

To attain this, the present invention generally comprises a panel. The panel has a top surface, a bottom surface, a bottom edge, two lower side edges extend away and taper outwardly from the bottom edge and two upper side edges each extend away and taper inwardly from one of the lower side edges such that the panel generally has a pentagonal shape. The panel comprises a cloth material. A flap portion has a bottom edge, a top edge, a first side edge and a second side edge. The bottom edge of the flap portion is integrally coupled to the bottom edge of the panel. The flap portion is abutted against the front surface of the panel to define a pocket. The legs of the baby are placed in the pocket and the panel wrapped about the baby.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby wrapping blanket apparatus and method which has many of the advantages of the baby blankets mentioned heretofore and many novel features that result in a new baby wrapping blanket which is not anticipated, rendered obvious, suggested, or even implied by any of the prior art baby blankets, either alone or in any combination thereof.

It is another object of the present invention to provide a new baby wrapping blanket which may be easily and efficiently manufactured and marketed.

It is a further object of the present invention to provide a new baby wrapping blanket which is of a durable and reliable construction.

An even further object of the present invention is to provide a new baby wrapping blanket which is susceptible of a low cost of manufacture with regard to both materials and labor, and which accordingly is then susceptible of low prices of sale to the consuming public, thereby making such baby wrapping blanket economically available to the buying public.

Still yet another object of the present invention is to provide a new baby wrapping blanket which provides in the apparatuses and methods of the prior art some of the advantages thereof, while simultaneously overcoming some of the disadvantages normally associated therewith.

Still another object of the present invention is to provide a new baby wrapping blanket for providing warmth and comfort to an infant.

Yet another object of the present invention is to provide a new baby wrapping blanket which includes a panel. The panel has a top surface, a bottom surface, a bottom edge two lower side edges extend away and taper outwardly from the bottom edge and two upper side edges each extend away and taper inwardly from one of the lower side edges such that the panel generally has a pentagonal shape. The panel comprises a cloth material. A flap portion has a bottom edge, a top edge, a first side edge and a second side edge. The bottom edge of the flap portion is integrally coupled to the bottom edge of the panel. The flap portion is abutted against the front surface of the panel to define a pocket. The legs of the baby are placed in the pocket and the panel wrapped about the baby.

Still yet another object of the present invention is to provide a new baby wrapping blanket that has a fastening means thereon for holding the blanket tight about the baby.

Even still another object of the present invention is to provide a new baby wrapping blanket that has a flap portion thereon to form a pocket to receive the feet of the baby.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic plan view of the present invention.

FIG. 4 is a schematic plan view of the present invention.

DESCRIPTION OF THE PREFERRED EMBODIMENT

Figure 1:
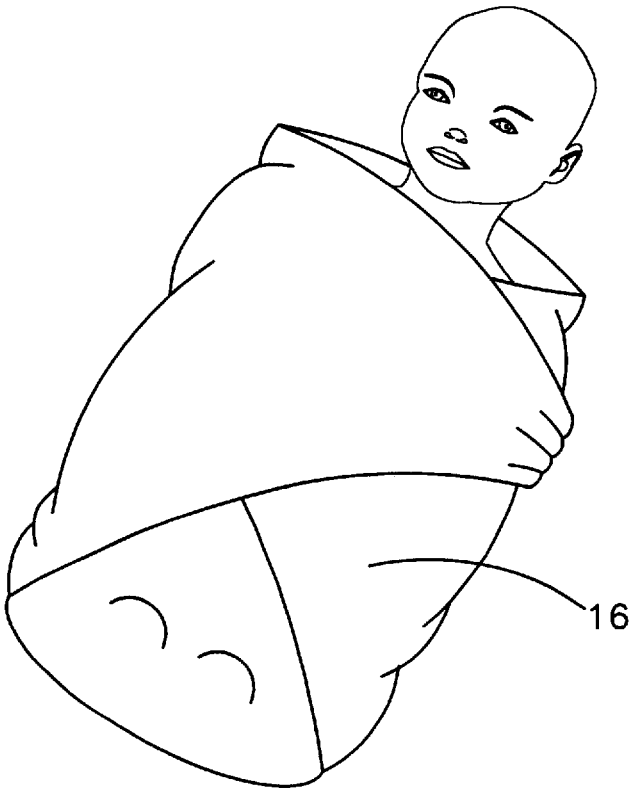
FIG. 1 is a schematic perspective view of a new baby wrapping blanket according to the present invention.
Figure 2:
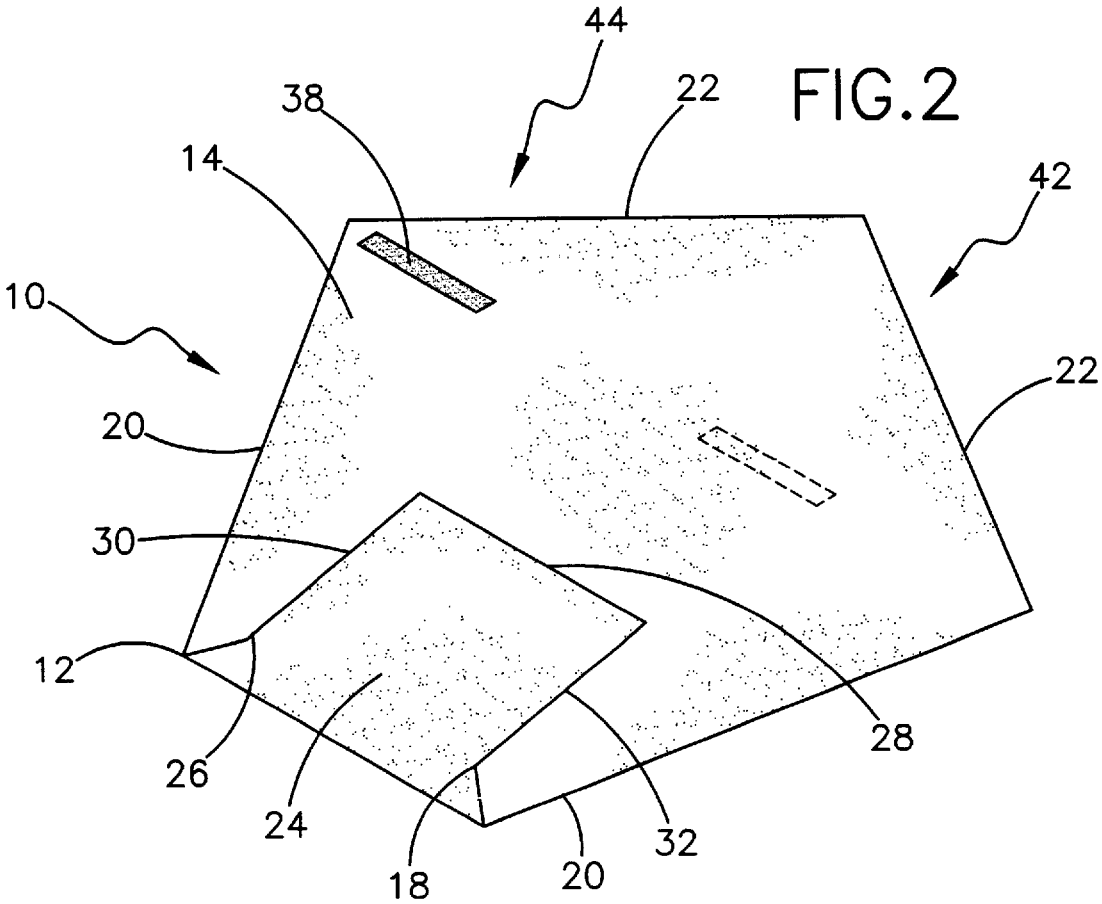
FIG. 2 is a schematic perspective view of the present invention.

With reference now to the drawings, and in particular to FIGS. 1 through 4 thereof, a new baby wrapping blanket embodying the principles and concepts of the present invention and generally designated by the reference numeral 10 will be described.

As best illustrated in FIGS. 1 through 4, the baby wrapping blanket 10 generally comprises a panel 12. The panel 12 has a top surface 14, a bottom surface 16, a bottom edge 18, two lower side edges 20 extending away and tapering outwardly from the bottom edge 18 and two upper side edges 22 each extending away and tapering inwardly from one of the lower side edges 20 such that the panel generally has a pentagonal shape. The panel 12 preferably comprises a cloth material which is ideally flannel or a quilted material.

A flap portion 24 has a bottom edge 26, a top edge 28, a first side edge 30 and a second side edge 32. The bottom edge 26 of the flap portion 12 is integrally coupled to the bottom edge 18 of the panel 12. The second side edge 32 of the flap portion is securely attached to the top surface 14 of the panel 12 such that a first portion 34 of each of the lower side edges 20 of the panel 12 are abutted against the top surface 14. The first portions 34 of the lower side edges 20 are securely attached to the top surface 14 of the panel 12. The flap portion 24 comprises a cloth material which is ideally flannel or a quilted material.

A securing means 36 selectively secures the first side edge 30 of the flap portion 24 to the top surface 14. Preferably the securing means 36 comprising a plurality of buttons. Also envisioned are a hook and loop securing means.

A fastening means fastens the top surface 14 of the panel 12 to the bottom surface 16 of the panel 12 to keep a baby wrapped up in the panel. The fastening means comprises a hook and loop fastening means. A hook portion 38 is securely attached to the top surface 14 and positioned generally adjacent to a juncture of one of the upper side edges 22 and one of the lower side edges 20. A loop portion 40 is securely attached to the back surface 16 and positioned such that the hook portion 38 may engage the loop portion 40 when the panel 12 is wrapped about the baby.

In use, a baby is placed on the panel and its feet are slid under the flap portion 24. The first edge 30 of the flap portion is secured to the panel 12. A first side 42 of the panel 12 is positioned over the baby. The second side 44, having the hook portion 38 of the hook and loop fastening means thereon, is fastened to the loop portion 40 on the first side 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An article for wrapping a baby, said article comprising:

a panel, said panel having a top surface, a bottom surface, a bottom edge, two lower side edges extending away and tapering outwardly from said bottom edge and two upper side edges each extending away and tapering inwardly from one of said lower side edges such that said panel generally has a pentagonal shape, said panel comprising a cloth material; and a flap portion, said flap portion having a bottom edge, a top edge, a first side edge and a second side edge, said bottom edge of said flap portion being integrally coupled to said bottom edge of said panel;

said second side edge of said flap portion being securely attached to said top surface of said panel such that a first portion of each of said lower side edges of said panel are abutted against said top surface, said first portions of said lower side edges being securely attached to said top surface of said panel, said flap portion comprising a cloth material, said cloth material comprising flannel.

2. The article for wrapping a baby as in claim 1, further comprising:

a fastening means for fastening said top surface of said panel to said bottom surface of said panel.

3. The article for wrapping a baby as in claim 2, wherein said fastening means comprises a hook fastening portion and a loop fastening portion, one fastening portion of said hook fastening portion and said fastening portion being securely attached to said top surface and positioned generally adjacent to a juncture of one of said upper side edges and one of said lower side edges, one fastening portion of said hook fastening portion and said fastening portion being securely attached to said back surface and positioned such that said hook portion may engage said loop portion when said panel is wrapped about a baby.

4. The article for wrapping a baby as in claim 2, wherein said fastening means further comprises:

a hook and loop fastening means, a hook portion being securely attached to said top surface and positioned generally adjacent to a juncture of one of said upper side edges and one of said lower side edges, a loop portion being securely attached to said back surface and positioned such that said hook portion may engage said loop portion when said panel is wrapped about a baby.

5. The article for wrapping a baby as in claim 1, further comprising:

a securing means for selectively securing said first side edge of said flap portion to said top surface.

6. An article for wrapping a baby, said article comprising:

a panel, said panel having a top surface, a bottom surface, a bottom edge, two lower side edges extending away and tapering outwardly from said bottom edge and two upper side edges each extending away and tapering inwardly from one of said lower side edges such that said panel generally has a pentagonal shape, said panel comprising a cloth material, said cloth material comprising flannel;

a flap portion, said flap portion having a bottom edge, a top edge, a first side edge and a second side edge, said bottom edge of said flap portion being integrally coupled to said bottom edge of said panel, said second side edge of said flap portion being securely attached to said top surface of said panel such that a first portion of each of said lower side edges of said panel are abutted against said top surface, said first portions of said lower side edges being securely attached to said top surface of said panel, said flap portion comprising a cloth material, said cloth material comprising flannel;

a securing means for selectively securing said first side edge of said flap portion to said top surface, said securing means comprising a plurality of buttons; and a fastening means for fastening said top surface of said panel to said bottom surface of said panel, said fastening means comprising a hook and loop fastening means, a hook portion being securely attached to said top surface and positioned generally adjacent to a juncture of one of said upper side edges and one of said lower side edges, a loop portion being securely attached to said back surface and positioned such that said hook portion may engage said loop portion when said panel is wrapped about a baby.

7. An article for wrapping a baby, said article comprising:

a panel having a top surface, a bottom surface, a bottom edge, two lower side edges extending away and outwardly from said bottom edge, and two upper side edges each extending away and inwardly from one of said lower side edges such that said panel generally has a pentagonal shape, said panel comprising a cloth material;

a flap portion having a bottom edge, a top edge, a first side edge, and a second side edge, said bottom edge of said flap portion being integrally coupled to said bottom edge of said panel, said second side edge of said flap portion being securely attached to said top surface of said panel; and a securing means for selectively securing said first side edge of said flap portion to said top surface;

wherein a first portion of each of said lower side edges of said panel are abutted against said top surface, said first portions of said lower side edges being securely attached to said top surface of said panel.

8. The article for wrapping a baby as in claim 7, further comprising:

a fastening means for fastening said top surface of said panel to said bottom surface of said panel.

9. The article for wrapping a baby as in claim 8, wherein said fastening means comprises a hook fastening portion and a loop fastening portion, one fastening portion of said hook fastening portion and said fastening portion being securely attached to said top surface and positioned generally adjacent to a juncture of one of said upper side edges and one of said lower side edges, one fastening portion of said hook fastening portion and said fastening portion being securely attached to said back surface and positioned such that said hook portion may engage said loop portion when said panel is wrapped about a baby.

* * * * *